US006316385B1

(12) United States Patent
Usuki et al.

(10) Patent No.: US 6,316,385 B1
(45) Date of Patent: Nov. 13, 2001

(54) THERMAL TRANSFER DYE-RECEPTIVE SHEETS AND RECEPTIVE LAYER TRANSFER SHEETS

(75) Inventors: Hideki Usuki; Hitoshi Saito; Takeshi Takada; Shino Takao, all of Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 09/689,666

(22) Filed: Oct. 13, 2000

(30) Foreign Application Priority Data

Oct. 14, 1999 (JP) ..... 11-293033

(51) Int. Cl.[7] ..... B41M 5/035; B41M 5/38

(52) U.S. Cl. ..... 503/227; 428/913; 428/914

(58) Field of Search ..... 8/471; 428/913, 428/914; 503/227

(56) References Cited

U.S. PATENT DOCUMENTS 5,362,702 * 11/1994 Sam et al. ..... 503/227

* cited by examiner

*Primary Examiner*—Bruce H. Hess
(74) *Attorney, Agent, or Firm*—Parkhurst & Wendel, L.L.P.

(57) ABSTRACT

A thermal transfer dye image-receiving sheet is provided which can form high-quality color images by a thermal transfer method. The thermal transfer dye image-receiving sheet comprises: a substrate sheet; and a dye-receptive layer provided on at least one side of the substrate sheet, the dye-receptive layer containing at least a caprolactone-modified cellulose, the cellulose comprising at least a cellulose acetate component.

9 Claims, 2 Drawing Sheets

THERMAL TRANSFER DYE-RECEPTIVE SHEETS AND RECEPTIVE LAYER TRANSFER SHEETS

TECHNICAL FIELD

The present invention relates to a thermal transfer dye image-receiving sheet which can produce high-quality color images by a thermal transfer method, a dye-receptive layer transfer sheet, and a thermal transfer dye image-receiving object produced by transferring a receptive layer from the dye-receptive layer transfer sheet onto any object.

BACKGROUND OF THE INVENTION

Various thermal transfer methods have hitherto been known in the art. Among others, a method has been proposed which comprises: providing a sublimable dye as a recording agent; supporting the sublimable dye on a substrate sheet, such as paper or a plastic film, to prepare a thermal transfer sheet; and transferring dyes from the thermal transfer sheet onto an image-receiving sheet, such as paper or a plastic film provided with a dye-receptive layer, to form various full-color images. In this case, a thermal head in a printer is used as heating means, and a large number of color dots of three or more colors are transferred onto an image-receiving sheet by heating for a very short period of time to reproduce a full-color image of an original by the large number of color dots.

The image-receiving sheet usable for the formation of images by the above method is limited, for example, to plastic sheets dyeable with dyes, or papers with a dye-receptive layer being previously provided thereon, and images cannot be formed directly on conventional plain papers or the like. It is a matter of course that, even in the case of conventional plain papers, for example, postcards, memo papers, letter papers, and report pads, image formation is possible when a dye-receptive layer is previously formed on the surface of these papers. The commercial production and sale of such a wide variety of image-receiving papers with a dye-receptive layer previously formed thereon, however, incur high cost, and, thus, the sale of them as an established image-receiving sheet is difficult. In order to solve this problem, the use of a dye-receptive layer transfer sheet has been proposed wherein, when the formation of an image on existing sheet products, such as plain papers, is contemplated, a dye-receptive layer can be simply formed only on a necessary portion(s) of the sheet (see, for example, Japanese Patent Laid-Open No. 264994/1987). Another known method for simplifying the procedure is to use a composite thermal transfer sheet. In this method, yellow, cyan, magenta, and optionally black dye layers are formed in a face serial manner on a plane of a continuous substrate sheet, and a transferable dye-receptive layer is further provided on the same plane of the substrate sheet. At the time of transfer, the dye-receptive layer is first transferred on an image-receiving sheet, and, subsequently, various dyes are transferred onto the transferred dye-receptive layer to form a full-color image. Further, a composite thermal transfer sheet, wherein a protective layer for protecting the formed dye image has been further formed in a face serial manner, has also been proposed.

Thus, as described above, a dye image is thermally transferred onto a receptive layer in a dye image-receiving sheet with a receptive layer being previously formed thereon, or onto a receptive layer in the thermal transfer dye image-receiving object produced by transferring a receptive layer from a receptive layer transfer sheet onto an object.

Further, the thermal transfer of a protective layer on the receptive layer with a dye image being formed thereon has been extensively carried out in the art in order to enhance fastness properties of prints formed by thermal transfer, such as abrasion resistance and lightfastness.

In forming a protective layer by thermal transfer on a receptive layer, with a dye image formed thereon, provided directly on the above image-receiving paper, or on a receptive layer, with a dye image formed thereon, in an image-receiving paper produced by transferring a receptive layer from a receptive layer transfer sheet onto a paper, however, many troubles occur including that, due to a release agent added for providing satisfactory releasability, such as a silicone oil or a phosphoric ester or fluoro-surfactant, the adhesion between the receptive layer and the protective layer is so low that the protective layer cannot be evenly transferred onto a predetermined region and, consequently, a high level of unevenness occurs, or otherwise, the protective layer is easily separated from the receptive layer during handling of prints.

The use, in the receptive layer, of a resin having relatively good releasability from the transfer sheet, such as polystyrene, cellulose acetate, or polyolefin, is also considered as means for reducing these troubles. These resins, however, cannot be substantially used because, as compared with polyesters, vinyl chloride-vinyl acetate copolymers and other resins commonly used in the art, they have lower dyeability (sensitivity) and are not substantially dyed.

Further, in recent years, shortening the printout time or energy saving, that is, power reduction, in the printout through printing at low energy has been demanded in the art. One means effective for printing at low energy is to increase the sensitivity of the receptive layer to permit the receptive layer to be more easily dyed with the transferred dye. Japanese Patent Laid-Open No. 274990/1986 describes that various plasticizers are added to increase the sensitivity of the receptive layer. Plasticizers having a molecular weight of not more than about 600, however, have a problem that they are likely to migrate within the receptive layer and cause a change in sensitivity according to a storage environment in which the dye-receptive layer is stored before printing. On the other hand, for plasticizers having a molecular weight of not less than 600, the larger the molecular weight, the better the stability. Therefore, the influence of the environment in which the dye-receptive layer is stored before printing is small. However, as the molecular weight is increased, that is, as the stability is increased, the compatible resin usable for a receptive layer is limited, or otherwise satisfactory plasticization effect cannot be attained. Further, since the plasticization of the resin for a receptive layer softens the resin, the resin is often likely to fuse to the transfer sheet. For this reason, the amount of the release agent required is larger than that in the case of the base resin alone without plasticizer loading. This causes the above-described troubles caused at the time of the adhesion of the protective layer to the receptive layer to become more serious.

Accordingly, it is an object of the present invention to provide a receptive layer which is satisfactorily releasable from a dye and a dye binder, can form good images by sublimation dye transfer with high sensitivity, and permits a protective layer to be normally transferred onto the receptive layer of prints.

DISCLOSURE OF THE INVENTION

In order to attain the above object of the present invention, at least a cellulose acetate-containing caprolactone-modified cellulose is incorporated into a dye-receptive layer in a thermal transfer dye image-receiving sheet comprising a dye-receptive layer provided on at least one side of a substrate sheet or a dye-receptive layer transfer sheet comprising a substrate sheet, a heat-resistant slip layer provided on one side of the substrate sheet, and a transferable dye-receptive layer releasably provided on at least a part of the substrate sheet in its side remote from the heat-resistant slip layer. By virtue of this constitution, the internal plasticization of the resin by caprolactone to improve dyeability with a dye and the freedom from bleeding or uneven distribution of caprolactone during the production of the thermal transfer dye image-receiving sheet permit the heat releasability of the dye-receptive layer from the transfer sheet to be exhibited by the cellulose acetate component without being inhibited. Therefore, the use of a release agent which inhibits the adhesion of the protective layer, such as a silicone oil or a phosphoric ester or fluoro-surfactant, can be reduced or can be made unnecessary. This makes it possible to normally transfer the protective layer onto the receptive layer with strong adhesion between the protective layer and the receptive layer.

According to the present invention, preferably, the cellulose acetate-containing caprolactone-modified cellulose has a mass average molecular weight (Mw) of 100000 to 200000 with the ratio of mass average molecular weight to number average molecular weight (Mn), Mw/Mn, being 1.5 to 2.5, and has a glass transition temperature (Tg) of 100° C. or above.

In the thermal transfer dye image-receiving sheet, a white intermediate layer may be further provided between the substrate sheet and the dye-receptive layer. Alternatively, in the dye-receptive layer transfer sheet, a white intermediate layer may be further provided on the dye-receptive layer.

A release layer may be provided between the transferable dye-receptive layer and the substrate sheet.

An adhesive layer may be provided on the surface of the transferable dye-receptive layer remote from the substrate sheet.

Preferably, the adhesive layer contains at least one member selected from the group consisting of polyester resins, vinyl chloride-vinyl acetate copolymer resins, acrylic resins, ultraviolet absorbing resins, butyral resins, and epoxy resins.

BEST MODE FOR CARRYING OUT THE INVENTION

The present invention will be described in more detail with reference to the following embodiments.

Figure 1:
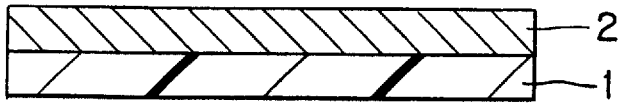
FIG. 1 is a cross-sectional view showing one embodiment of the thermal transfer dye image-receiving sheet according to the present invention.

FIG. 1 is a cross-sectional view showing one embodiment of the thermal transfer dye image-receiving sheet according to the present invention, wherein a dye-receptive layer 2 is provided on one side of a substrate sheet 1. The dye-receptive layer 2 contains a cellulose acetate-containing caprolactone-modified cellulose.

Figure 2:
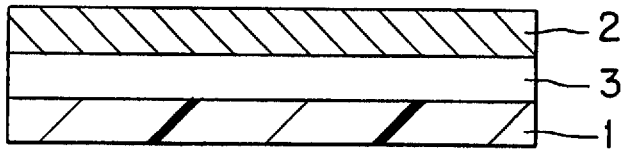
FIG. 2 is a cross-sectional view showing another embodiment of the thermal transfer dye image-receiving sheet according to the present invention.

FIG. 2 is a cross-sectional view showing another embodiment of the thermal transfer dye image-receiving sheet according to the present invention. In this thermal transfer dye image-receiving sheet, a dye-receptive layer 2 is provided on one side of a substrate sheet 1 through a white intermediate layer 3. According to this embodiment, concealing and/or whitening the ground and the ground color of the substrate can avoid a change in gloss or color of image caused by the influence of the ground or the ground color of the substrate.

Figure 3:
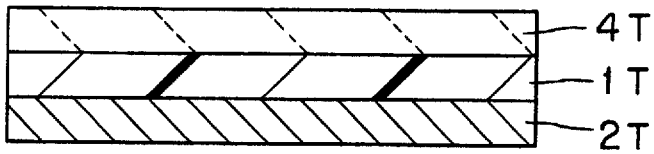
FIG. 3 is a cross-sectional view showing one embodiment of the receptive layer transfer sheet according to the present invention.
Figure 4:
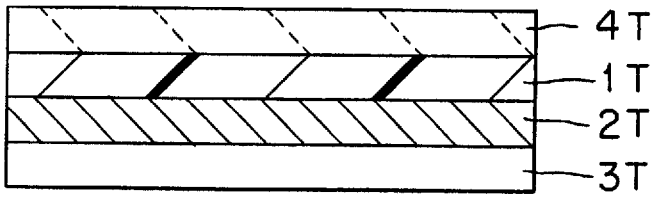
FIGS. 4 to 7 are cross-sectional views showing other embodiments of the receptive layer transfer sheet according to the present invention.

The thermal transfer dye image-receiving sheet shown in FIG. 1 may be formed by coating a liquid for a dye-receptive layer directly on a substrate sheet by gravure printing, screen printing, reverse roll coating using a gravure plate or other formation means and then drying the coating. On the other hand, the thermal transfer dye image-receiving sheet shown in FIG. 2 may be formed by stacking a white intermediate layer 3 and a dye-receptive layer 2 in that order on a substrate sheet. Further, the thermal transfer dye image-receiving sheet may be formed by adhering an assembly from a transfer sheet as shown in FIGS. 3 or 4 onto a desired substrate by heat or pressure, for example, by a laser, a thermal head, a laminator, a press, or a press roller. At that time, in the multilayer construction shown in FIG. 2, each layer may be provided on a releasable transfer sheet, followed by successive transfer of the layers. Alternatively, a transfer sheet having a multilayer construction may be previously provided, followed by transfer at a time. The transfer sheet may adopt constructions as shown in FIGS. 3 to 7 according to the present invention.

FIG. 3 is a cross-sectional view showing one embodiment of the receptive layer transfer sheet according to the present invention. In the receptive layer transfer sheet, a heat-resistant slip layer 4T is provided on one side of a substrate sheet 1T, and a transferable dye-receptive layer 2T is provided on the other side of the substrate sheet 1T. The transferable dye-receptive layer 2T is releasable from the substrate sheet 1T, and contains a cellulose acetate-containing caprolactone-modified cellulose.

FIG. 4 is a cross-sectional view showing another embodiment of the receptive layer transfer sheet according to the present invention. In this receptive layer transfer sheet, a heat-resistant slip layer 4T is provided on one side of a substrate sheet 1T, and a transferable dye-receptive layer 2T and a white intermediate layer 3T are provided in that order on the other side of the substrate sheet 1T. The transferable dye-receptive layer 2T is releasable from the substrate sheet 1T. Further, the dye-receptive layer 2T separated by thermal transfer is adhered to the object through the white intermediate layer 3T. This conceals and/or whitens the ground or the ground color of the object and consequently avoids a change in gloss or color of images caused by the influence of the ground or the ground color of the object.

Figure 5:
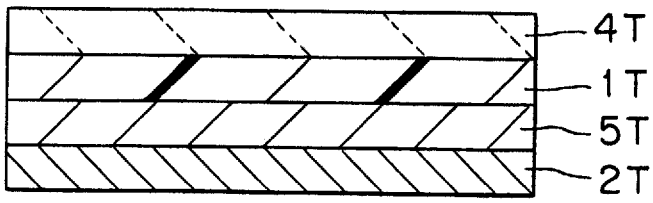

FIG. 5 is a cross-sectional view showing still another embodiment of the receptive layer transfer sheet according to the present invention. In this receptive layer transfer sheet, a heat-resistant slip layer 4T is provided on one side of a substrate sheet 1T, and a transferable dye-receptive layer 2T is provided on the other side of the substrate sheet 1T through a release layer 5T. According to this construction, the transferable dye-receptive layer 2T is easily released from the substrate sheet 1T through the release layer 5T.

Figure 6:
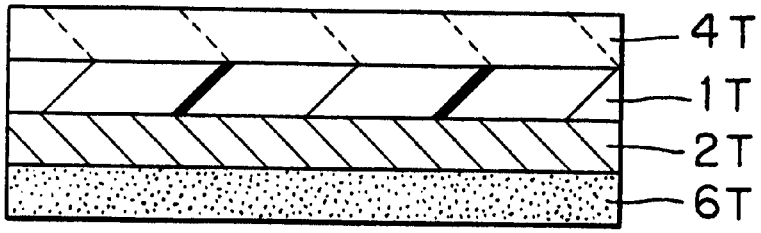

FIG. 6 is a cross-sectional view showing a further embodiment of the receptive layer transfer sheet according to the present invention. In the receptive layer transfer sheet, a heat-resistant slip layer 4T is provided on one side of a substrate sheet 1T, and a transferable dye-receptive layer 2T and an adhesive layer 6T are provided in that order on the other side of the substrate sheet 1T. According to this construction, the transferable dye-receptive layer 2T is releasable from the substrate sheet 1T. Further, the dye-receptive layer 2T is transferred onto the object through the adhesive layer 6T so that the dye-receptive layer 2T separated by thermal transfer is strongly adhered to the object.

Figure 7:
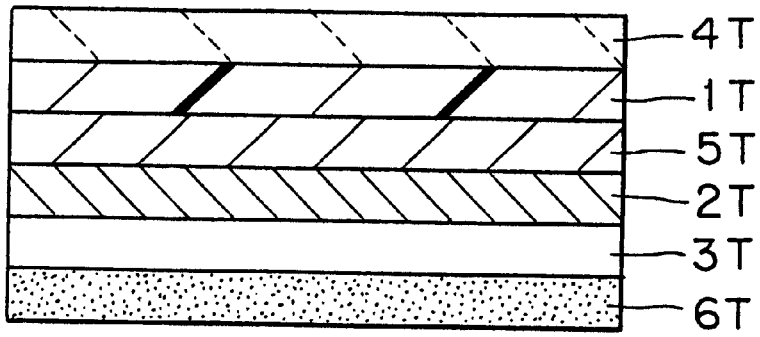

FIG. 7 is a cross-sectional view showing a further embodiment of the receptive layer transfer sheet according to the present invention. In this embodiment, all the functional layers described above are included as individual layers. Besides the white intermediate layer 3T, at least one functional layer properly selected from conventional functional layers may be additionally provided between the dye-receptive layer 2T and the adhesive layer 6T. The order of the provision of these layers and the number of these layers provided are not particularly limited so far as the order is proper from the viewpoints of the function of the layers and the production.

Figure 8:
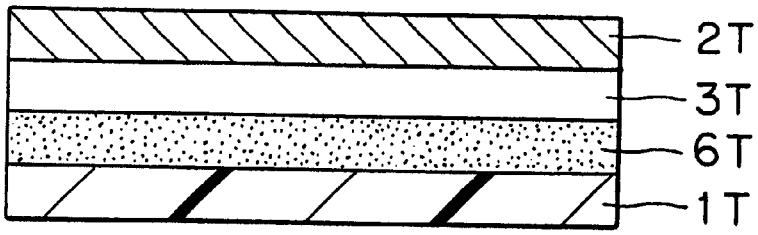
FIG. 8 is a cross-sectional view showing one embodiment of the thermal transfer dye image-receiving object of the present invention produced by transferring an assembly including a receptive layer from a receptive layer transfer sheet shown in FIG. 7, which is one embodiment of the receptive layer transfer sheet of the present invention, onto an object.

FIG. 8 is a cross-sectional view showing one embodiment of the thermal transfer dye image-receiving object of the present invention produced by transferring an assembly including a receptive layer from a receptive layer transfer sheet shown in FIG. 7, which is one embodiment of the receptive layer transfer sheet of the present invention, onto an object.

Layers constituting the thermal transfer dye image-receiving sheet and the receptive layer transfer sheet according to the present invention will be described.

(Substrate sheet 1 of thermal transfer dye image-receiving sheet)

Substrate sheets commonly used in conventional thermal transfer dye image-receiving sheets as such may be used as the substrate sheet 1 in the thermal transfer dye image-receiving sheet according to the present invention. Other substrate sheets may also be used without particular limitation. Specific examples of preferred substrate sheets include: synthetic papers (such as polyolefin and polystyrene synthetic papers); cellulose fiber papers, such as wood free papers, art papers, coated papers, cast coated papers, wall papers, backing papers, synthetic resin- or emulsion-impregnated papers, synthetic rubber latex-impregnated papers, papers with synthetic resin internally added thereto, and paperboards; and films or sheets of various plastics, such as polyolefins, polyvinyl chloride, polyethylene terephthalate, polystyrene, polymethacrylate, and polycarbonate. Further, for example, white opaque films produced by adding a white pigment or a filler to these synthetic resins and forming films from the mixtures, or foamed films produced by foaming the resin may also be used without particular limitation. A laminate of any combination of the above substrate sheets may also be used. Examples of representative laminates include a laminate composed of a cellulose fiber paper and a synthetic paper and a laminate composed of a cellulose fiber paper and a plastic film or sheet. The thickness of the substrate sheet may be any desired one, and is, for example, generally about 10 to 300 $\mu$m. When the substrate sheet has poor adhesion to the receptive layer formed on its surface, the surface is preferably subjected to primer treatment or corona discharge treatment.

Any conventional intermediate layer may be provided between the receptive layer and the substrate sheet from the viewpoints of imparting adhesion, whiteness, cushioning properties, antistatic properties, opacifying properties, anticurling properties and the like. Likewise, any conventional backside layer may be provided on the substrate sheet in its surface remote from the receptive layer from the viewpoints of imparting suitability for carrying, writing quality, stain resistance, anticurling properties, antistatic properties and the like. Further, for the antistatic properties, an antistatic layer containing a conventional antistatic agent may be further provided on the receptive layer and the backside layer.

(Substrate sheet 1T for receptive layer transfer sheet)

Substrate sheets commonly used in conventional thermal transfer sheets as such may be used as the substrate sheet 1T in the receptive layer transfer sheet according to the present invention. Other substrate sheets may also be used without particular limitation. Specific examples of preferred substrate sheets include tissue papers, such as glassine paper, capacitor paper, and paraffin paper; plastics, for example, polyesters such as polyethylene terephthalate and polyethylene naphthalate, polypropylene, cellophane, polycarbonate, cellulose acetate, polyethylene, polyvinyl chloride, polystyrene, nylon, polyimide, polyvinylidene chloride, and ionomers; and composite substrate sheets comprising combinations of the papers and the plastics. The thickness of the substrate sheet may be properly varied depending upon materials for the substrate sheet so that the substrate sheet has proper strength, heat resistance and other properties. However, the thickness is preferably 2 to 100 $\mu$m.

(Dye-receptive layer 2 and transferable dye-receptive layer 2T)

Regarding the thermal transfer dye image-receiving sheet and the receptive layer transfer sheet according to the present invention, in the dye-receptive layer 2 or the transferable dye-receptive layer 2T formed on the substrate sheet, the dye-receptive layer 2 as such receives a sublimation dye being transferred from the thermal transfer sheet and holds the formed image on its surface, while the transferable dye-receptive layer is first transferred onto any desired object to form a dye-receptive layer which receives a sublimation dye being transferred from the thermal transfer sheet and holds the formed image on its surface. The dye-receptive layer according to the present invention contains a cellulose acetate-containing caprolactone-modified cellulose.

The cellulose acetate-containing caprolactone-modified cellulose should necessarily have a moiety, in which hydroxyl groups of cellulose have been esterified with acetic acid, and a moiety in which a caprolactone chain has been modified. Reactive hydroxyl groups in the cellulose may be entirely esterified with acetic acid and used in the modification of caprolactone. Alternatively, a part of the hydroxyl groups may remain unused or may be esterified or etherified with an alkyl. Preferred celluloses include caprolactone-modified cellulose acetate (caprolactone-modified CA), caprolactone-modified cellulose acetate propionate (caprolactone-modified CAP), and caprolactone-modified cellulose acetate butyrate (caprolactone-modified CAB).

In this caprolactone-modified cellulose, the mass ratio of cellulose to caprolactone is cellulose/caprolactone=about 1/1 to 5/1. The number of reactive hydroxyl groups in cellulose is three per unit of cellulose. Among these reactive hydroxyl groups, the number of hydroxyl groups esterified with acetic acid (preferred compound) (number of acetic acids) is preferably not less than 0.6, more preferably not less than 1.2.

The state of the modified caprolactone according to the present invention is not particularly limited, and the modified caprolactone may have a chain length of a polymer, a prepolymer, an oligomer, or a macromer produced by ester polymerizing caprolactone, may have plurality of chain lengths, or may be branched. Polycaprolactone is commercially available as a simple compound. Therefore, unlike the present invention, polycaprolactone may be blended instead of modification. In the case of blending, however, satisfactory releasability cannot be provided, or otherwise it is difficult to provide a clear coating for the receptive layer, due to compatibility with cellulose acetate, which is not very good, or bleeding of caprolactone during production although the reason has not been fully elucidated yet. By contrast, according to the present invention, the caprolactone has been added to a chemical structure of cellulose acetate or the like. Therefore, there is no possibility that the caprolactone is brought to a free state and migrates onto the surface of the receptive layer. By virtue of this nature, when the protective layer is transferred onto the receptive layer, the adhesion between the receptive layer and the protective layer is strong. Further, since the caprolactone is in the state of addition to a chemical structure of cellulose acetate or the like, the releasability from the dye layer upon heating is excellent. In addition, the thermoplastic resin constituting the main chain, such as cellulose acetate, functions to impart dyeability with a dye to the receptive layer.

The caprolactone-modified compound is particularly preferably a caprolactone-modified cellulose acetate. A caprolactone-modified cellulose acetate having a mass average molecular weight (Mw) of 100,000 to 200,000 with the ratio of mass average molecular weight to number average molecular weight (Mn), Mw/Mn, being 1.5 to 2.5, and has a glass transition temperature (Tg) of 100° C. or above can offer good results in terms of releasability from the thermal transfer sheet upon heating and dyeability with a dye.

In the dye-receptive layer, the caprolactone-modified compound may be optionally mixed with other resins, for example, polyolefin resins, such as polypropylene, halogenated polymers, such as polyvinyl chloride, vinyl chloride-vinyl acetate copolymer, and polyvinylidene chloride, vinyl polymers, such as polyvinyl acetate and poly (meth) acrylic esters, polyester resins, polystyrene resins, such as acrylonitrile styrene and (meth)acrylstyrene elastomer, polyamide resins, resins based on copolymers of olefins, such as ethylene or propylene, with other vinyl monomers, ionomers, and polycarbonates.

In order to impart the heat releasability of the dye-receptive layer from the thermal transfer sheet, the use of a release agent is not necessarily required because the cellulose acetate component is present. If necessary, however, the release agent may be added. Release agents usable herein include silicone oils, phosphoric ester surfactants, and fluorosurfactants. Among them, silicone oils and/or fluorosurfactants are preferred. Modified silicone oils, for example, alkyl-modified, aryl-modified, for example, phenyl-modified, benzyl-modified, or α-methylstyrene-modified, epoxy-modified, amino-modified, carboxyl-modified, alcohol-modified, fluorine-modified, alkylaralkyl polyether-modified, epoxy-polyether-modified, and polyester-modified silicone oils, are preferred.

One or at least two release agents may be used. The amount of the release agent added is preferably 0 to 10 parts by mass based on 100 parts by mass of the dye-receptive layer forming resin. When the amount of the release agent added is larger than the upper limit of the above amount range, the release agent is likely to bleed out on the surface of the dye-receptive layer and, consequently, when the protective layer is formed on the receptive layer, the adhesion of the protective layer to the receptive layer is likely to be poor.

The dye-receptive layer may be formed by dissolving the resin with additives, such as a release agent, being optionally added thereto in a suitable organic solvent to prepare a solution, or dispersing the resin with additives, such as a release agent, being optionally added thereto in a suitable organic solvent or water to prepare a dispersion, coating the solution or dispersion, for example, by gravure printing, screen printing, or reverse roll coating using a gravure plate, and then drying the coating. The dye-receptive layer thus formed may have any desired thickness. In general, however, the thickness of the dye-receptive layer is 1 to 10 μm. This dye-receptive layer is preferably a continuous coating. Alternatively, the dye-receptive layer may be a discontinuous coating formed from a resin emulsion or a resin dispersion.

(White intermediate layer 3 or 3T)

Further, according to the present invention, an (white) intermediate layer may be provided between the dye-receptive layer and the substrate sheet in the thermal transfer dye image-receiving sheet or between the dye-receptive layer and the adhesive layer. The intermediate layer may be formed of, for example, polyurethane resin, acrylic resin, polyethylene resin, butadiene rubber, or epoxy resin. The thickness of the intermediate layer is preferably about 2 to 10 μm. The intermediate layer may be formed in the same manner as used in the formation of the dye-receptive layer. A white intermediate layer 3 or 3T may be formed by incorporating a white pigment, a brightening agent and/or air bubbles (or a foaming agent) into the intermediate layer. The white pigment and the brightening agent function to improve the whiteness of the transferred dye-receptive layer or to conceal the pale yellow color of paper as the image-receiving sheet. On the other hand, the air bubbles (or foaming agent) function to impart good cushioning properties to the dye-receptive layer. These additives may be incorporated into the intermediate layer by incorporating a white pigment or the like into a coating liquid used for the formation of the layer.

(Heat-resistant Slip Layer 4T)

In the receptive layer transfer sheet according to the present invention, a heat-resistant slip layer 4T is provided on the backside of the substrate sheet, that is, on the substrate sheet in its side remote from the transferable dye-receptive layer, from the viewpoint of avoiding adverse effects, such as sticking or cockling caused by heat from the thermal head.

Any conventional resin may be used as the resin for the formation of the heat-resistant slip layer, and examples thereof include polyvinylbutyral resins, polyvinylacetoacetal resins, polyester resins, vinyl chloride-vinyl acetate copolymers, polyether resins, polybutadiene resins, styrene-butadiene copolymers, acrylic polyols, polyurethane acrylates, polyester acrylates, polyether acrylates, epoxy acrylates, urethane or epoxy prepolymers, nitrocellulose resins, cellulose nitrate resins, cellulose acetopropionate resins, cellulose acetate butyrate resins, cellulose acetate hydrogenphthalate resins, cellulose acetate resins, aromatic polyamide resins, polyimide resins, polycarbonate resins, and chlorinated polyolefin resins.

Slip property-imparting agents added to or coated on the heat-resistant slip layer formed of the above resin include phosphoric esters, silicone oils, graphite powders, silicone graft polymers, fluoro graft polymers, acrylic silicone graft polymers, acrylsiloxanes, arylsiloxanes, and other silicone polymers. Preferably, the heat-resistant slip layer is formed of a polyol, for example, a polyalcohol polymer compound, a polyisocyanate compound, or a phosphoric ester compound. Further, the addition of a filler is more preferred.

The heat-resistant slip layer may be formed by dissolving or dispersing the above resin, slip property-imparting agent, and filler in a suitable solvent to prepare an ink for a heat-resistant slip layer, coating the ink on the backside of the substrate sheet, for example, by gravure printing, screen printing, or reverse coating using a gravure plate, and drying the coating.

(Release layer 5T)

A release layer 5T may be formed between the substrate sheet and the transferable dye-receptive layer. The release layer is formed of a material having excellent releasability, such as a wax, a silicone wax, a silicone resin, or a fluororesin, or a resin having a relatively high softening point which does not melt upon exposure to heat of a thermal head, for example, a cellulosic resin, an acrylic resin, a polyurethane resin, a polyvinyl acetal resin, or the above resin with a release agent, which functions under heating, such as wax, being incorporated therein. The release layer may be formed in the same manner as used in the formation of the dye-receptive layer. A release layer thickness of about 0.5 to 5 $\mu$m suffices for the contemplated results. When a dye-receptive layer, which becomes matte upon transfer, is desired, the incorporation of various particles in the release layer or matting treatment of the surface of the release layer on the dye-receptive layer side can provide a dye-receptive layer having a matte surface.

(Adhesive layer 6T)

According to the present invention, an adhesive layer 6T is preferably provided on the surface of the transferable dye-receptive layer from the viewpoint of improving the transferability of the dye-receptive layer and the like. The adhesive layer may be formed of any conventional pressure-sensitive adhesive or heat-sensitive adhesive, more preferably a thermoplastic resin having a glass transition temperature of 50 to 80° C. For example, it is preferred to select a resin having a suitable glass transition temperature from resins having good adhesion in a hot state, for example, from polyester resins, vinyl chloride-vinyl acetate copolymer resins, acrylic resins, ultraviolet absorbing resins, butyral resins, epoxy resins, polyamide resins, and vinyl chloride resins. In particular, for the adhesive layer, the incorporation of at least one resin selected from polyester resins, vinyl chloride-vinyl acetate copolymer resins, acrylic resins, ultraviolet absorbing resins, butyral resins, and epoxy resins is preferred. The above-described resins preferably have a low molecular weight from the viewpoint of the adhesion and when a pattern is formed by means of heating means such as a thermal head on a partial area rather than the whole area. Further, a coating liquid for the adhesive layer may be mixed with the coating liquid for the white intermediate layer 3T so that the formed coating can serve both as an adhesive layer and a white intermediate layer. Further, a white pigment, a brightening agent and/or air bubbles (or a foaming agent) may be incorporated into the adhesive layer so that the formed adhesive layer is a white adhesive layer which serves also as the white intermediate layer.

The above ultraviolet absorbing resin is a resin produced by bonding a reactive ultraviolet absorber to a thermoplastic resin or an ionizing radiation-curable resin through a reaction. More specifically, for example, a reactive group, such as an addition-polymerizable double bond (for example, a vinyl, acryloyl, or methacryloyl group) or an alcoholic hydroxyl, amino, carboxyl, epoxy, or isocyanate group is introduced into a conventional nonreactive organic ultraviolet absorbing agent, for example, a salicylate, phenyl acrylate, benzophenone, benzotriazole, cumarin, triazine, or nickel chelate nonreactive organic ultraviolet absorbing agent.

A coating liquid containing the resin for constituting the adhesive layer and optional additives, such as inorganic or organic fillers, is coated, and the coating is dried to form an adhesive layer preferably having a thickness of about 0.5 to 10 $\mu$m.

(Protective layer)

A protective layer releasable and transferable from the substrate sheet may be provided on the substrate sheet (in its receptive layer-formed side), in the receptive layer transfer sheet of the present invention, in its positions different from the receptive layer-formed region. Alternatively, the protective layer may be formed on a substrate sheet separate from the receptive layer transfer sheet.

The thermally transferable protective layer may be formed of various resins commonly known as a resin for a protective layer. Examples of resins for a protective layer include: polyester resins, polystyrene resins, acrylic resins, polyurethane resins, acrylated urethane resins; resins produced by modifying the above resins with a silicone; mixtures of the above resins, ionizing radiation-curable resins; and ultraviolet screening resins. If necessary, ultraviolet absorbers, organic fillers and/or inorganic fillers may also be properly added.

An ionizing radiation-cured resin-containing protective layer has exceptional plasticizer resistance and scratch resistance. Conventional ionizing radiation-curable resins may be used for the ionizing radiation-cured resins. For example, a radically polymerizable polymer or oligomer may be crosslinked and cured by ionizing radiation irradiation. If necessary, a photopolymerization initiator may be added, followed by polymerization crosslinking by electron beam or ultraviolet irradiation.

The ultraviolet screening resin or the ultraviolet absorber is added to the protective layer with a view mainly to imparting lightfastness to prints. An example of the ultraviolet screening resin is a resin produced by bonding a reactive ultraviolet absorber to a thermoplastic resin or the above ionizing radiation-curable resin through a reaction. More specifically, for example, a reactive group, such as an addition-polymerizable double bond (for example, a vinyl, acryloyl, or methacryloyl group) or an alcoholic hydroxyl, amino, carboxyl, epoxy, or isocyanate group is introduced into a conventional nonreactive organic ultraviolet absorbing agent, for example, a salicylate, phenyl acrylate, benzophenone, benzotriazole, cumarin, triazine, or nickel chelate nonreactive organic ultraviolet absorbing agent. The ultraviolet absorber may be a conventional nonreactive organic ultraviolet absorber, and examples thereof include salicylate, phenyl acrylate, benzophenone, benzotriazole, cumarin, triazine, and nickel chelate ultraviolet absorbing agents.

Specific examples of organic fillers and inorganic fillers include, but are not particularly limited to, polyethylene wax, bisamide, nylon, acrylic resin, crosslinked polystyrene, silicone resin, silicone rubber, talc, calcium carbonate, titanium oxide, and finely divided silica, such as microsilica and colloidal silica. Preferred are organic and inorganic fillers possessing good slip properties and having a particle diameter of not more than 10 $\mu$m, preferably 0.1 to 3 $\mu$m. The amount of the filler added is 0 to 100 parts by mass based on 100 parts by mass of the resin and is preferably such that, upon transfer onto the receptive layer, the transparency is maintained.

The thickness of the thermally transferable protective layer is generally about 0.5 to 10 μm, although the thickness varies depending upon the type of the resin for the protective layer.

As described above in connection with the receptive layer transfer sheet, the thermally transferable protective layer may be formed on the substrate sheet through the release layer. Further, the adhesive layer as described above in connection with the receptive layer transfer sheet may be formed on the surface of the protective layer.

The receptive layer transfer sheet according to the present invention may be formed by releasably providing the above-described transferable dye-receptive layer on a substrate sheet and, if necessary, coating a protective layer and a dye layer in a face serial manner in positional relationship with the receptive layer.

The object, on which a dye-receptive layer is transferred from the above receptive layer transfer sheet followed by the formation of an image, is not particularly limited. For example, the object may be any sheet of plain papers, wood free papers, tracing papers, plastic films and the like. The object may be in any form of cards, postcards, passports, letter papers, report pads, notes or notebooks, catalogues and the like. In particular, the present invention is applicable to plain papers having high surface roughness and rough papers. The dye-receptive layer and the protective layer may be transferred by using any heating-pressing means, which can heat the dye-receptive layer or the adhesive layer to a temperature at which this layer can be activated, for example, a conventional printer provided with a thermal head for thermal transfer, a hot stamper for foil transfer, or a hot roll. An image may be formed by any conventional means. For example, a contemplated purpose can be satisfactorily attained by applying a thermal energy of about 5 to 100 mJ/mm$^2$ by means of a recording apparatus, such as a thermal printer (for example, video printers VY-170 and VY-VP 10, manufactured by Hitachi, Ltd. and video printer CP-700, manufactured by Mitsubishi Electric Corporation), through the control of the recording time.

EXAMPLES

The present invention will be described in more detail with reference to the following examples and comparative examples. In the following examples and comparative examples, "parts" or "%" is by mass unless otherwise specified.

The following cellulose acetate-containing caprolactone-modified celluloses were provided.

TABLE 1

| | Cellulose/ caprolactone (mass ratio) | Number of acetic acids | Number of butyric acids | Number of propionic acids |
|---|---|---|---|---|
| Cellulose 1 | 10/7 | 2.4 | — | — |
| Cellulose 2 | 10/3 | 2.4 | — | — |
| Cellulose 3 | 10/3 | 1.7 | — | — |
| Cellulose 4 | 10/3 | 1.2 | — | 1.2 |
| Cellulose 5 | 10/3 | 0.6 | 1.8 | — |

For each type of acid, the number of acids represents the number of hydroxyl groups, esterified by the acid, among the three hydroxyl groups per unit of cellulose. The reason why, in the table, the total number of acids for each type of acid in each of the celluloses 1 to 5 is less than 3, is that, since the remaining hydroxyl groups have been used in the modification of caprolactone, the number of the remaining hydroxyl groups is unknown and could not be determined by analysis.

Example 1

A synthetic paper (a polyethylene terephthalate sheet, thickness 180 μm) was provided as a substrate sheet. The following white intermediate layer was bar coated on one side of the substrate sheet at a coverage of 1.5 g/m$^2$ on a dry basis. The coating was dried at 110° C. for 30 sec. Coating liquids for a dye-receptive layer, prepared by diluting each of the celluloses 1 to 5, listed in the above table 1, with methyl ethyl ketone/toluene (mass ratio=1/1) to a solid content of 16% by mass were bar coated on the dried coating at a coverage of 4.0 g/m$^2$ on a dry basis, and the coatings were dried at 110° C. for 30 sec. Thus, thermal transfer image-receiving sheets of Examples 1-1 to 1-5 were prepared.

| Coating liquid for white intermediate layer | |
|---|---|
| •Chlorinated polypropylene resin (B-13, manufactured by Toyo Kasei Kogyo Co., Ltd.) | 10 parts |
| •Brightening agent (Uvitex OB, manufactured by CIBA-GEIGY CO.) | 1 part |
| •Titanium oxide (TCA-888, manufactured by Tohchem Products Corporation) | 30 parts |
| •Methyl ethyl ketone/toluene = 1/1 (mass ratio) | 90 parts |

Example 2

The following coating liquid for a release layer was coated by gravure printing on the surface of a polyethylene terephthalate film (PET, thickness 6.0 μm. manufactured by Toray Industries, Inc.) having a heat-resistant slip layer on its backside at a coverage of 1.0 g/m$^2$ on a dry basis. The coating was pre-dried by a drier, and then dried in an oven kept at 110° C. for 30 sec to form a release layer. Coating liquids for a dye-receptive layer, prepared by diluting each of the celluloses 1 to 5, listed in the above table 1, with methyl ethyl ketone/toluene (mass ratio=1/1) to a solid content of 16% by mass were then gravure printed on the surface of the dried coating at a coverage of 1.5 g/m$^2$ on a dry basis, and the coatings were pre-dried by a drier and then dried in an oven at 110° C. for 30 sec to form dye-receptive layers. Further, in the same manner as described above, the following coating liquid for an adhesive layer was coated on the surface of the dye-receptive layers at a coverage of 1.5 g/m$^2$ on a dry basis, and the coatings were dried to form adhesive layers. Thus, receptive layer transfer sheets of Examples 2-1 to 2-5 according to the present invention were prepared.

| Coating liquid for release layer | |
|---|---|
| •Ionomer resin (manufactured by Mitsui Chemicals Inc.) | 10 parts |
| •Water/ethanol = 2/3 (mass ratio) | 100 parts |
| **Coating liquid for adhesive layer** | |
| •Vinyl chloride-vinyl acetate copolymer resin (1000 ALK, manufactured by Denki Kagaku Kogyo K.K.) | 20 parts |
| •Methyl ethyl ketone | 40 parts |
| •Toluene | 40 parts |

Comparative Example 1

Thermal transfer image-receiving sheets of Comparative Example 1 were prepared in the same manner as in Example 1, except that only the coating liquid for a dye-receptive layer was replaced with a coating liquid having the following composition.

| Coating liquid for dye-receptive layer | |
|---|---|
| •Cellulose acetate (L-30, manufactured by Daicel Chemical Industries, Ltd.) | 16 parts |
| •Solvent (methyl ethyl ketone/toluene mass ratio 1:1) | 84 parts |

Comparative Example 2

Thermal transfer image-receiving sheets of Comparative Example 2 were prepared in the same manner as in Example 1, except that only the coating liquid for a dye-receptive layer was replaced with a coating liquid having the following composition.

| Coating liquid for dye-receptive layer | |
|---|---|
| •Cellulose acetate (L-30, manufactured by Daicel Chemical Industries, Ltd.) | 12 parts |
| •Polycaprolactone (Placcel H-7, manufactured by Daicel Chemical Industries, Ltd.) | 4 parts |
| •Solvent (methyl ethyl ketone/toluene mass ratio 1:1) | 86 parts |

Comparative Example 3

A PET-G card was provided as a card not dyeable with a dye or a card not releasable from a dye binder. An attempt to form an image was made by thermally transferring a dye from a dye layer-bearing thermal transfer sheet directly onto the card without the transfer of a receptive layer from the receptive layer transfer sheet as prepared in Examples 1 to 2.

Comparative Example 4

An A-PET card was provided as a card not dyeable with a dye or a card not releasable from a dye binder. An attempt to form an image was made by thermally transferring a dye from a dye layer-bearing thermal transfer sheet directly onto the card without the transfer of a receptive layer from the receptive layer transfer sheet as prepared in Examples 1 to 2.

Comparative Example 5

A polycarbonate card was provided as a card not dyeable with a dye or a card not releasable from a dye binder. An attempt to form an image was made by thermally transferring a dye from a dye layer-bearing thermal transfer sheet directly onto the card without the transfer of a receptive layer from the receptive layer transfer sheet as prepared in Examples 1 to 2.

Comparative Example 6

A release layer, a dye-receptive layer, and an adhesive layer were coated in that order on a PET film coated with a heat-resistant slip layer in the same manner as in Example 2, except that, in the formation of the dye-receptive layer, the following coating liquid free from any release agent was used. Thus, a receptive layer transfer sheet of Comparative Example 6 was prepared.

| Coating liquid for receptive layer | |
|---|---|
| •Vinyl chloride-vinyl acetate copolymer resin | 50 parts |
| •Methyl ethyl ketone | 25 parts |
| •Toluene | 25 parts |

A transfer film PK 700 L for a video printer CP-700 manufactured by Mitsubishi Electric Corporation was provided as a thermal transfer film. Further, the thermal transfer image-receiving sheets prepared in Example 1 and Comparative Examples 1 and 2 as such were provided. For the receptive layer transfer sheets prepared in Example 2 and Comparative Example 6, a dye-receptive layer was transferred from these receptive layer transfer sheets onto an object (a sheet for a card not having dyeability with a dye or a sheet for a card not releasable from a dye binder) to prepare image-receiving objects. In Comparative Examples 3 to 5, an image was formed directly on each sheet without transfer of the receptive layer onto the object. The thermal transfer film and the thermal transfer image-receiving sheets or image-receiving objects were put on top of the other so that the dye layer faced the dye-receptive face. Thermal transfer recording was carried out by means of a thermal head under the following conditions from the backside of the transfer film in the order of Y, M, and C. Thus, gradation images of gray were formed. A protective layer was thermally transferred from a protective layer transfer sheet having the following construction onto the receptive layer with the sublimation dye image formed thereon so as to form a protective layer on the whole area of the prints.

(Protective layer transfer sheet)

| | |
|---|---|
| Coating liquid for release layer | |
| •Ionomer resin (manufactured by Mitsui Chemicals Inc.) | 10 parts |
| •Water/ethanol = 2/3 (mass ratio) | 100 parts |
| Coating liquid for protective layer | |
| •Acrylic resin (Dianal BR-83, manufactured by Mitsubishi Rayon Co., Ltd.) | 20 parts |
| •Methyl ethyl ketone | 40 parts |
| •Toluene | 40 parts |
| Coating liquid for adhesive layer | |
| •Vinyl chloride-vinyl acetate copolymer resin (1000 ALK, manufactured by Denki Kagaku Kogyo K.K.) | 10 parts |
| •Ultraviolet absorber-modified acryl copolymer resin (UVA 635 L, manufactured by BASF Japan Ltd.) | 10 parts |
| •Methyl ethyl ketone | 40 parts |
| •Toluene | 40 parts |

(Receptive layer transfer conditions for formation of dye image-forming object)

Thermal head: KGT-217-12 MPL20, manufactured by Kyocera Corp.

Average resistance value of heating element: 3195 Ω

Print density in scanning direction: 300 dpi

Print density in feed direction: 300 dpi

Applied power: 0.12 w/dot

One line period: 5 msec

Printing initiation temp.: 40° C.

Applied pulse:

A multipulse-type test printer was used wherein the number of divided pulses with a pulse length obtained by equally dividing one line period into 256 parts is variable from 0 to 255 during one line period. In this case, the duty ratio for each divided pulse was fixed to 60%, and the number of pulses per line period was fixed to 255.

(Conditions for printing of gray gradation image)

Thermal head: KGT-217-12 MPL20, manufactured by Kyocera Corp.

Average resistance value of heating element: 3195 Ω

Print density in scanning direction: 300 dpi

Print density in feed direction: 300 dpi

Applied power: 0.12 w/dot

One line period: 5 msec

Printing initiation temp.: 40° C.

Gradation control method:

A multipulse-type test printer was used wherein the number of divided pulses with a pulse length obtained by equally dividing one line period into 256 parts is variable from 0 to 255 during one line period. In this case, the duty ratio for each divided pulse was fixed to 60%, and, according to the gradation, the number of pulses per line period was brought to 0 for step 0, 17 for step 1, 34 for step 2 and the like. In this way, the number of pulses was successively increased from 0 to 255 by 17 for each step. Thus, 16 gradation steps from step 0 to step 15 were controlled.

(Conditions for transfer of protective layer)

Thermal head: KGT-217-12 MPL20, manufactured by Kyocera Corp.

Average resistance value of heating element: 3195 Ω

Print density in scanning direction: 300 dpi

Print density in feed direction: 300 dpi

Applied power: 0.12 w/dot

One line period: 5 msec

Printing initiation temp.: 40° C.

Applied pulse:

A multipulse-type test printer was used wherein the number of divided pulses with a pulse length obtained by equally dividing one line period into 256 parts is variable from 0 to 255 during one line period. In this case, the duty ratio for each divided pulse was fixed to 60%, and the number of pulses per line period was fixed to 210.

(Evaluation method)

The image-receiving sheets and image-receiving objects with an image formed thereon were evaluated for dyeability with a dye and releasability from the dye layer of the thermal transfer sheet upon heating, and the transferability of the protective layer.

(Releasability upon heating)

In the printing of the image-receiving sheets and the image-receiving objects under the above conditions, the level of fusing between the dye layer of the thermal transfer sheet and the receptive layer was visually inspected, and the results were evaluated according to the following criteria.

○: The dye layer could be released from the receptive layer without fusing.

X: The dye layer was partially or entirely fused and abnormally transferred without normal releasability.

(Dyeability with dye)

The image-receiving sheets and image-receiving objects with an image formed thereon under the above conditions were visually inspected for dyeability with a dye. The results were evaluated according to the following criteria.

○: A maximum OD of not less than 2.0

X: A maximum OD of less than 2.0

—: The dyeability with a dye could not be evaluated due to abnormal transfer of the dye layer to the receptive layer.

(Transferability of protective layer)

A protective layer was thermally transferred from a protective layer transfer sheet onto the cards (receptive layer) with an image formed thereon under the above conditions to visually inspect the transferability of the protective layer. The results were evaluated according to the following criteria.

○: Good transferability of protective layer

X: Poor transferability of protective layer (Results of evaluation)

The results of evaluation are summarized in Table 2 below.

TABLE 2

| | | Results of evaluation | | | |
|---|---|---|---|---|---|
| | Object as substrate | Heat releas-ability | Dye-ability | Transferability of protective layer | Overall evalu-ation |
| Ex. 1-1 | — | ○ | ○ | ○ | ○ |
| Ex. 1-2 | — | ○ | ○ | ○ | ○ |
| Ex. 1-3 | — | ○ | ○ | ○ | ○ |
| Ex. 1-4 | — | ○ | ○ | ○ | ○ |
| Ex. 1-5 | — | ○ | ○ | ○ | ○ |
| Ex. 2-1 | PET-G | ○ | ○ | ○ | ○ |
| | A-PET | ○ | ○ | ○ | ○ |
| | Polycarbonate | ○ | ○ | ○ | ○ |
| Ex. 2-2 | PET-G | ○ | ○ | ○ | ○ |
| | A-PET | ○ | ○ | ○ | ○ |
| | Polycarbonate | ○ | ○ | ○ | ○ |
| Ex. 2-3 | PET-G | ○ | ○ | ○ | ○ |
| | A-PET | ○ | ○ | ○ | ○ |
| | Polycarbonate | ○ | ○ | ○ | ○ |
| Ex. 2-4 | PET-G | ○ | ○ | ○ | ○ |
| | A-PET | ○ | ○ | ○ | ○ |
| | Polycarbonate | ○ | ○ | ○ | ○ |
| Ex. 2-5 | PET-G | ○ | ○ | ○ | ○ |
| | A-PET | ○ | ○ | ○ | ○ |
| | Polycarbonate | ○ | ○ | ○ | ○ |
| Comp. Ex. 1 | — | ○ | × | × | × |
| Comp. Ex. 2 | — | Coated face became opaque, and normal receptive layer surface could not be formed. | | | × |
| Comp. Ex. 3 | PET-G | × | — | — | × |
| Comp. Ex. 4 | A-PET | × | — | — | × |
| Comp. Ex. 5 | Polycarbonate | × | — | — | × |
| Comp. Ex. 6 | PET-G | × | — | — | × |
| | A-PET | × | — | — | × |
| | Polycarbonate | × | — | — | × |

As is apparent from the results of evaluation, in the receptive layers according to the examples of the present invention, the use of a caprolactone-modified cellulose acetate in the receptive layer could realize good releasability from the dye layer upon heating without use of any release agent, the freedom from troubles such as jamming at the time of image formation, and high sensitivity in printing. By contrast, for comparative examples, the dye layer was fused to the card, and the releasability from the dye layer upon heating was poor. Therefore, the transferability of the protective layer after image formation could not be evaluated. Otherwise, the dyeability with a dye was very low even though the releasability upon heating was good.

Thus, according to the present invention, at least a cellulose acetate-containing caprolactone-modified cellulose is incorporated into a dye-receptive layer in a thermal transfer dye image-receiving sheet comprising a dye-receptive layer provided on at least one side of a substrate sheet or a dye-receptive layer transfer sheet comprising a substrate sheet, a heat-resistant slip layer provided on one side of the substrate sheet, and a transferable dye-receptive layer releasably provided on at least a part of the substrate sheet in its side remote from the heat-resistant slip layer. By virtue of this constitution, the internal plasticization of the resin by caprolactone to improve dyeability with a dye and the freedom from bleeding or uneven distribution of caprolactone during the production of the thermal transfer dye image-receiving sheet permit the heat releasability of the dye-receptive layer from the transfer sheet to be exhibited by the cellulose acetate component without being inhibited. Therefore, the use of a release agent which inhibits the adhesion of the protective layer, such as a silicone oil or a phosphoric ester or fluoro-surfactant, can be reduced or eliminated. This makes it possible to normally transfer the protective layer onto the receptive layer with strong adhesion between the protective layer and the receptive layer. Further, the use of a dye-receptive layer transfer sheet permits sharp and good sublimation transferred images to be formed on objects not dyeable with a dye or not releasable from dyes and dye binders.

What is claimed is:

1. A thermal transfer dye image-receiving sheet comprising: a substrate sheet; and a dye-receptive layer provided on at least one side of the substrate sheet, said dye-receptive layer containing at least a caprolactone-modified cellulose, said cellulose comprising at least a cellulose acetate component.

2. A dye-receptive layer transfer sheet comprising:

a substrate sheet having a heat-resistant slip layer on its one side; and a transferable dye-receptive layer provided releasably on at least a part of the surface of the substrate sheet opposite to the heat-resistant slip layer side, said transferable dye-receptive layer containing at least a caprolactone-modified cellulose, said cellulose comprising at least a cellulose acetate component.

3. The dye-receptive layer transfer sheet according to claim 2, which further comprises a white intermediate layer provided on the dye-receptive layer.

4. The receptive layer transfer sheet according to claim 2, which further comprises a release layer provided between the transferable dye-receptive layer and the substrate sheet.

5. The receptive layer transfer sheet according to claim 2, which further comprises an adhesive layer provided on the surface of the transferable dye-receptive layer opposite to the substrate sheet side.

6. The receptive layer transfer sheet according to claim 5, wherein the adhesive layer contains at least one member selected from the group consisting of polyester resins, vinyl chloride-vinyl acetate copolymer resins, acrylic resins, ultraviolet absorber resins, butyral resins, and epoxy resins.

7. A thermal transfer dye image-receiving object comprising: a predetermined object; and a dye-receptive layer provided on the object, the dye-receptive layer having been formed by transferring a transferable dye-receptive layer onto the object from a dye-receptive layer transfer sheet, said dye-receptive layer transfer sheet comprising:

a substrate sheet having a heat-resistant slip layer on its one side; and a transferable dye-receptive layer provided releasably on at least a part of the surface of the substrate sheet opposite to the heat-resistant slip layer side, said transferable dye-receptive layer containing at least a caprolactone-modified cellulose, said cellulose comprising at least a cellulose acetate component.

8. The thermal transfer dye image-receiving sheet, the dye-receptive layer transfer sheet and the thermal transfer dye image-receiving object according to any one of claims 1, 2 to 7, wherein the cellulose acetate-containing caprolactone-modified cellulose has a mass average molecular weight (Mw) of 100000 to 200000 with the ratio of mass average molecular weight to number average molecular weight (Mn), Mw/Mn, being 1.5 to 2.5, and has a glass transition temperature (Tg) of 100° C. or above.

9. The thermal transfer dye image-receiving sheet and the thermal transfer dye image-receiving object according to claim 1, 2 or 4, wherein a white intermediate layer is provided between the substrate sheet and the dye-receptive layer.

* * * * *